US009994794B2

(12) United States Patent
Ma et al.

(10) Patent No.: US 9,994,794 B2
(45) Date of Patent: Jun. 12, 2018

(54) METHOD FOR EXTRACTING CINNAMON OIL

(71) Applicant: INFINITUS (CHINA) COMPANY LTD., Jiang Men (CN)

(72) Inventors: Chung Wah Ma, Jiang Men (CN); Fangli Ma, Jiang Men (CN); Renhuai Cong, Jiang Men (CN); Xiuying Kou, Jiang Men (CN); Chuixin Qin, Jiang Men (CN)

(73) Assignee: INFINITUS (CHINA) COMPANY LTD., Jiang Men (CN)

( * ) Notice: Subject to any disclaimer, the term of this patent is extended or adjusted under 35 U.S.C. 154(b) by 110 days.

(21) Appl. No.: 15/241,305

(22) Filed: Aug. 19, 2016

(65) Prior Publication Data

US 2017/0158985 A1 Jun. 8, 2017

(30) Foreign Application Priority Data

Dec. 2, 2015 (CN) ..... 2015 1 0882713

(51) Int. Cl.
*C11B 9/02* (2006.01)

(52) U.S. Cl.
CPC ..... *C11B 9/025* (2013.01); *C11B 9/027* (2013.01)

(58) Field of Classification Search
CPC ..... C11B 9/025; C11B 9/027
USPC ..... 512/5
See application file for complete search history.

(56) References Cited

U.S. PATENT DOCUMENTS

2011/0200692 A1* 8/2011 Ovadia ..... A61K 36/54 424/739

* cited by examiner

*Primary Examiner* — Arrie L Reuther
(74) *Attorney, Agent, or Firm* — Parker Highlander PLLC

(57) ABSTRACT

The present invention discloses a method for extracting cinnamon oil; firstly, a cinnamon powder is mixed and conditioned with an aqueous solution of sodium salts, and the conditioned cinnamon powder is obtained thereafter; subsequently, the conditioned cinnamon powder obtained was frozen and then rapidly thawed, and the thawed cinnamon powder is obtained thereafter; finally, after the thawed cinnamon powder is mixed with a gaseous solvent, pressurized liquid extraction is performed, and then after separation the cinnamon oil is obtained. The method for extracting cinnamon oil from cinnamon at a low temperature adds an aqueous solution of sodium salts to condition the cinnamon powder, uses a slow freezing process and a rapid thawing process, and finally uses a gaseous solvent, which may gasify without heating to be separated from the extract; the extraction process is kept away from air, and the heat-sensitive components are not damaged.

10 Claims, No Drawings

METHOD FOR EXTRACTING CINNAMON OIL

CROSS REFERENCE OF RELATED APPLICATIONS

The present application claims the priority of Chinese Patent Application No. 201510882713.X, as filed on Dec. 2, 2015 and titled with "Method for extracting cinnamon oil", and the disclosure of which is incorporated herein by reference.

FIELD

The present invention relates to the technical field of the extraction of volatile oil, in particular to a method for extracting cinnamon oil.

BACKGROUND

Cinnamon, formerly known as *C. loureirii* and also known as cassia, Chinese cinnamon, etc., first appears in "*Tang materia medica*" and is first recorded in "*Shennong's classic of materia medica*"; it is the dry bark of *Cinnamomum cassia Presl*. mainly produced in the provinces of Guangdong, Guangxi, Yunnan and so on; the bark with a fragrance may be used as a flavoring and is an edible and medicinal plant material disclosed by China's Ministry of Health.

Cinnamon is pungent, sweet and hot in nature, and goes to the channels of kidney, spleen, heart and liver; it has the effects of supplementing heat, reinforcing yang, dissipating cold, relieving pain, warming channels and unblocking vessels, and is widely used in clinical practice for the symptoms of deficiency in kidney yang, decline of fire in life gate, decline of yang in spleen and kidney, and cold and pain in gastral cavity. The main effective components of cinnamon are volatile oil, terpenoids, flavanols and the like, wherein the content of volatile oil is 1.2%~2%. Cinnamon oil is yellow or brownish yellow clear liquid, and is generally obtained by steam distillation; it has the specific fragrance of cinnamon, a sweet taste, a relative density of 1.055~1.070, and a refractive index of 1.602~1.614. Cinnamon oil has a main chemical component of cinnamaldehyde, with additionally methyl eugenol, cinnamic alcohol, cinnamyl acetate, coumarin, vanillin, eugenol and the like. Modern research has found that cinnamon oil has sedative, analgesic, antipyretic, anticonvulsant, gastrointestinal peristalsis-enhancing, choleretic and antitumor effects; it is a main raw material in pharmaceutical, food and chemical industries, and is more commonly used in food such as beverage, confectionary, canned food and the like in food industry. Consequently, cinnamon oil has enormous application prospects in the development of health food and novel medicines, and has great value in research and utilization.

Currently, the methods for extracting cinnamon oil mainly include steam distillation, solvent extraction, supercritical $CO_2$ extraction and the like. Steam distillation is immersional wetting and then distilling the coarse powders or flakes of cinnamon by direct heating or introducing steam, condensing and then collecting the volatile components brought out with steam distillation, and obtaining essential oil after oil-water separation. Steam distillation as a conventional method for extracting essential oil has the advantages of simple equipments, easy operation, no organic solvent retention and the like. However, this method also has the disadvantages of high extraction temperature, large energy consumption, long extraction time and a low yield of essential oil. In addition, long heating time easily causes loss of effective components, and meanwhile, the raw material will be charred when overheating, producing an adverse effect on the fragrance of the essential oil. Solvent extraction typically uses organic solvents such as petroleum ether, n-hexane, ethanol and the like for extraction; the oil obtained by extraction mostly contains some non-volatile components, and there tend to be much phenomenon of solvent retention when separating these solvents from the essential oil, depriving the product of naturality. Supercritical $CO_2$ has special properties determining its unique superiority with respect to the extraction of oil and of nonpolar substances such as natural ingredients and the like, namely high speed and yield, and thus is widely applied to the extraction of the components of flavorings and medicinal herbs. However, there are a strict requirement for and a great investment in the equipments due to the need for a high pressure environment; the small volume of extraction tanks due to the high pressure state for extraction and the limited production capacity make it unable to form large-scale industrial production, imposing a high cost on the product.

Therefore, it is always an urgent problem to be solved by the manufacturers in this industry to find a method for extracting cinnamon oil with low energy consumption, a short time, substantially no solvent retention and meanwhile a high yield, as well as the easiness to realize industrialization.

SUMMARY

In view of this, the technical problem to be solved by the present invention is to provide a method for extracting cinnamon oil; the extraction method provided by the present invention has the advantages of low extraction temperature, a short time, a high yield, substantially no solvent retention and the like, with a simple process, mild reaction conditions and the easiness to realize industrialization.

The present invention provides a method for extracting cinnamon oil, including the steps of:

A) mixing and conditioning a cinnamon powder with an aqueous solution of sodium salts, and obtaining the conditioned cinnamon powder thereafter;

B) freezing and then rapidly thawing the conditioned cinnamon powder obtained in the above step, and obtaining the thawed cinnamon powder thereafter; and C) after mixing the thawed cinnamon powder with a gaseous solvent, carrying out pressurized liquid extraction, and then after separation obtaining the cinnamon oil.

Preferably, the cinnamon powder were sieved to select particles with diameters between 40 mesh and 80 mesh.

Preferably, the aqueous solution of sodium salts includes aqueous solutions of sodium chloride and/or sodium bicarbonate.

The aqueous solution of sodium salts has a concentration of 1%~12%, and the mass ratio of the aqueous solution of sodium salts to the cinnamon powder is 5%~15%.

Preferably, the conditioning is sealing and resting; the conditioning time is 2~8 h.

Preferably, the freezing temperature is −10° C.~−20° C., and the freezing time is 3~9 h.

Preferably, the temperature rising rate of the rapid-thawing is 1−10° C./min, and the rapid-thawing time is 5~20 min.

Preferably, the gaseous solvent has a boiling point temperature of −50° C.~1° C., and the ratio of the gaseous solvent volume to the cinnamon powder mass is (5~10)ml:1 g;

the gaseous solvent includes propane and/or butane.

Preferably, the extraction temperature is 10~45° C., the extraction pressure is 0.1~1 MPa, and the extraction time is 10~50 min.

Preferably, a purification step is also included after the separation.

Preferably, the purification is purification by molecular distillation;

the molecular distillation pressure is $10^{-4}$~$10^{-5}$ MPa, and the molecular distillation temperature is 45~65° C.

The present invention discloses a method for extracting cinnamon oil, including the steps of: firstly, mixing and conditioning a cinnamon powder with an aqueous solution of sodium salts, and obtaining the conditioned cinnamon powder thereafter; subsequently, freezing and then rapidly thawing the conditioned cinnamon powder obtained in the above step, and obtaining the thawed cinnamon powder thereafter; finally, after mixing the thawed cinnamon powder with a gaseous solvent, carrying out pressurized liquid extraction, and then after separation obtaining the cinnamon oil. Compared with the prior art, the method for extracting volatile oil (essential oil) at low temperature from cinnamon provided by the present invention adds an aqueous solution of sodium salts to condition the cinnamon powder, which may facilitate water permeation into the cinnamon, bring the cinnamon powder in sufficient contact with water, accelerate the seeping of the cinnamon oil from cell walls, and improve the microwave energy absorbance of the raw material, aiding in the rapid-thawing pretreatment in the next step. It also uses slow freezing to form large ice crystals in the broken cinnamon cells; the ice crystals gasify rapidly in the rapid-thawing process, and the organizations in cinnamon cells expand under pressure and produce a micro-expansion effect, thus sufficiently breaking the cinnamon cell structure, reducing the diffusion resistance to the extracting solvent in cell organizations, and greatly speeding up the extraction. Finally it uses a gaseous solvent, which is easily liquefied under pressure, has a boiling point at or below zero, may be used for sealed extraction at low temperature and pressure, and may gasify without heating to be separated from the extract with almost no solvent retention; the extraction process is kept away from air, the extract is not easily oxidized, and the heat-sensitive components are not damaged. The experimental process shows that the extraction method provided by the present invention has the advantages of low extraction temperature, a short time, a high yield, substantially no solvent retention and the like, with a simple process, mild reaction conditions and the easiness to realize industrialization. The experimental results show that the yield of the extracted essential oil with the method provided by the present invention can reach 7.5%, and the cinnamaldehyde content in the purified essential oil can reach 97%.

DETAILED DESCRIPTION

To further understand the present invention, preferred experiments of the present invention are described below in conjunction with examples, but it is to be understood that these descriptions are only further illustrations of the features and the advantages of the present invention, rather than limitations to the patent claims of the present invention.

All the raw materials of the present invention are not particularly limited in their sources, as long as they are purchased in the market or prepared according to conventional methods well known by those skilled in the art.

All the raw materials of the present invention are not particularly limited in their purities, and those of analytical purity are preferably employed in the present invention.

The present invention provides a method for extracting cinnamon oil, including the steps of:

A) mixing and conditioning a cinnamon powder with an aqueous solution of sodium salts, and obtaining the conditioned cinnamon powder thereafter;

B) freezing and then rapidly thawing the conditioned cinnamon powder obtained in the above step, and obtaining the thawed cinnamon powder thereafter; and C) after mixing the thawed cinnamon powder with a gaseous solvent, carrying out pressurized liquid extraction, and then after separation obtaining the cinnamon oil.

The present invention firstly mixes and conditions a cinnamon powder with an aqueous solution of sodium salts, and obtains the conditioned cinnamon powder thereafter. The source of the cinnamon powder is not particularly limited in the present invention, as long as it is a source well known by those skilled in the art, and the present invention obtains it preferably after pulverizing the commercially available cinnamon; the condition of the cinnamon powder is not particularly limited in the present invention, as long as it is a condition of cinnamon well known by those skilled in the art, and for the convenience of the subsequent extracting process, the cinnamon powder in the present invention preferably has a particles diameters of 40~80 mesh, more preferably 50~70 mesh and most preferably 55~65 mesh. The aqueous solution of sodium salts preferably include the aqueous solutions of sodium chloride and/or sodium bicarbonate; the aqueous solution of sodium salts has a mass concentration preferably of 1%~12%, more preferably 2%~11%, and most preferably 5%~10~%; the mass ratio of the aqueous solution of sodium salts to the cinnamon powder is preferably 5%~15%, more preferably 7%~12%, and most preferably 8%~10~%. The means of mixing is not particularly limited in the present invention, as long as it is a means of mixing well known by those skilled in the art, and the mixing in the present invention is preferably by stirring well; the means of conditioning is not particularly limited in the present invention, and to improve the efficiency of the subsequent operational process, the conditioning in the present invention is preferably by sealing and resting; the time for the conditioning is preferably 2~8 h, more preferably 3~7 h, and most preferably 4~6 h.

The present invention uses a dilute solution of salts to condition the cinnamon powder, which may facilitate water permeation into the cinnamon, bring the cinnamon powder in sufficient contact with water, accelerate the seeping of the cinnamon oil from cell walls, and improve the thermal energy absorbance of the raw material, aiding in the rapid-thawing pretreatment in the next step.

The present invention obtains the conditioned cinnamon powder via the above steps, and then after freezing and rapidly thawing it obtains the thawed cinnamon powder. The temperature of the freezing is preferably −10° C.~−20° C., more preferably −12° C.~−18° C., and most preferably −14° C.~−16° C.; the time of the freezing is preferably 3~9 h, more preferably 4~8 h, and most preferably 5~7 h. Other conditions of the freezing are not particularly limited in the present invention, as long as they are freezing conditions well known by those skilled in the art; the means of the freezing is not particularly limited in the present invention, as long as it is a means of freezing well known by those skilled in the art, and the freezing in the present invention is preferably slow freezing or conventional freezing, and more preferably slow freezing; the rate of the slow freezing is not particularly limited in the present invention, and may be adjusted by those skilled in the art according to practical production conditions, product requirements or quality control standards.

The temperature rising rate of the rapid thawing in the present invention is preferably 1–10° C./min, more preferably 2~9° C./min, more preferably 4~7° C./min, and most preferably 5~6° C./min; the time of the rapid thawing is preferably 5~20 min, more preferably 8~17 min, and most preferably 10~15 min. Other conditions of the rapid thawing are not particularly limited in the present invention, as long as they are rapid thawing conditions well known by those skilled in the art; the means of the rapid thawing is not particularly limited in the present invention, as long as it is a means of rapid thawing well known by those skilled in the art, and it may be selected by those skilled in the art according to practical production conditions and is preferably rapid thawing by microwave radiation in the present invention.

The present invention uses slow freezing to form large ice crystals in the broken cinnamon cells; preferably, the ice crystals gasify rapidly in the rapid-thawing process by microwave radiation, and the organizations in cinnamon cells expand under pressure and produce a micro-expansion effect, thus sufficiently breaking the cinnamon cell structure, reducing the diffusion resistance to the extracting solvent in cell organizations, and greatly speeding up the extraction.

After mixing the thawed cinnamon powder obtained in the above steps with a gaseous solvent, the present invention performs pressurized liquid extraction, and then after separation obtains the cinnamon oil. The gaseous solvent is not particularly limited in the present invention, as long as it is a gaseous solvent well known by those skilled in the art; in the present invention, it is a gaseous solvent that can be used for extraction at low temperature and pressure and preferably is in gaseous state at normal temperature and pressure and easily liquefied when being pressurized, or the temperature is preferably in the range of −50° C.~1° C., more preferably −45° C.~0.5° C. and more preferably −45° C.~0° C., and most preferably it is propane and/or butane; the ratio of the gaseous solvent volume to the cinnamon powder mass is preferably (5~10)ml:1 g, more preferably (6~9)ml:1 g, and most preferably (7~8)ml:1 g.

The temperature of the pressurized liquid extraction in the present invention is preferably 10~45° C., more preferably 15~40° C., and most preferably 20~35° C.; the time of the pressurized liquid extraction is preferably 10~50 min, more preferably 15~45 min, and most preferably 25~35 min. The pressure of the pressurized liquid extraction is not particularly limited in the present invention, and may be adjusted by those skilled in the art according to practical production conditions; it is preferably a pressure under which the extracting solvent can always remain in the liquid state, and more preferably, the pressure of the extraction is 0.1~1 MPa, more preferably 0.2~0.8 MPa, and most preferably 0.4~0.6 MPa. The equipment of the pressurized liquid extraction is not particularly limited in the present invention, and may be selected by those skilled in the art according to practical production conditions; in the present invention, it is preferably a sealable pressure extraction tank, more preferably a pressure extraction tank that can withstand a pressure above 1.3 MPa, and more preferably a pressure extraction tank that can withstand a pressure above 1.3 MPa with a tank body material of stainless steel and bearing a heating jacket and devices for monitoring and controlling temperature and pressure. Other conditions of the pressurized liquid extraction are not particularly limited in the present invention, and may be adjusted by those skilled in the art according to practical production conditions; in the present invention, the pressure extraction tank is preferably treated by vacuumizing prior to the pressurized liquid extraction. In the present invention, for the convenience of the extraction process and the subsequent separation process, the specific steps are also preferably loading the thawed cinnamon powder into a 100~300 mesh net, tying the opening, then putting it into the extraction tank, vacuumizing before injecting a gaseous solvent, and then performing pressurized liquid extraction.

The present invention preferably uses the solvents that are easily liquefied when being pressurized such as butane, propane and the like, which have a boiling point at or below zero, may be used for sealed extraction at low temperature and pressure, and may gasify without heating to be separated from the extract; it has the features of low extraction temperature, a short time, a simple process and mild reaction conditions, with substantially no solvent retention and the easiness to realize industrialization. Also, the extraction process is kept away from air, the extract is not easily oxidized, and the heat-sensitive components are not damaged.

The conditions of the separation are not particularly limited in the present invention, as long as they are separation conditions well known by those skilled in the art, and they may be adjusted by those skilled in the art according to practical production conditions, product requirements or quality control standards; the temperature of the separation in the present invention is preferably 5~35° C., more preferably 10~30° C., and most preferably 15~25° C. The specific process of the separation is not particularly limited in the present invention, as long as it is a separation process well known by those skilled in the art; the specific process in the present invention preferably is: after completing the pressurized liquid extraction, leading the liquid extract from the extraction tank into a sealable pressure separation tank with a lid that has been previously evacuated, keeping the temperature of the separation tank at 5~35° C., recovering the solvent gasified from the top of the separation tank using a compressor until the pressure in the separation tank drops to 0.05~0.1 Mpa or below, and retaining the extracted crude essential oil (volatile oil) at the bottom of the separation tank after it is separated from the solvent. Other equipments in the separation process are not particularly limited in the present invention; the sealable pressure separation tank is more preferably a pressure separation tank that can withstand a pressure above 1.3 MPa, and more preferably a pressure separation tank that can withstand a pressure above 1.3 MPa with a tank body material of stainless steel and installing a heating jacket and devices for monitoring and controlling temperature and pressure; the compressor is preferably a diaphragm compressor.

The present invention also preferably includes a purification step after the separation to improve the purity of the cinnamon oil. The means of the purification is not preferably limited in the present invention, as long as it is a means of purification well known by those skilled in the art; in the present invention, the purification is preferably purification by molecular distillation; the pressure of the molecular distillation is preferably $10^{-4}$~$10^{-5}$ MPa; the temperature of the molecular distillation is preferably 45~65° C., more preferably 50~60° C., and most preferably 53~57° C. The specific process of the purification is not particularly limited in the present invention, as long as it is a purification process well known by those skilled in the art; the specific process in the present invention preferably is: leading the extracted crude essential oil out from the bottom of the separation tank into a molecular distillation device, and performing distillation under a vacuum degree of $10^{-4}$~$10^{-5}$ MPa at a temperature of 45~65° C. to obtain a heavy phase of non-volatile components and a light phase of essential oil (cinnamon oil).

The present invention extracts cinnamon oil from cinnamon at a low temperature through the above steps, firstly a dilute solution of salts is used to condition the cinnamon powder, which may facilitate water permeation into the cinnamon, bring the cinnamon powder in sufficient contact with water, accelerate the seeping of the cinnamon oil from cell walls, and improve the thermal energy absorbance of the raw material, aiding in the rapid-thawing pretreatment in the next step. Next, slow freezing is used to form large ice crystals in the broken cinnamon cells; the ice crystals gasify rapidly in the rapid-thawing process preferably by microwave radiation, and the organizations in cinnamon cells expand under pressure and produce a micro-expansion effect, thus sufficiently breaking the cinnamon cell structure, reducing the diffusion resistance to the extracting solvent in cell organizations, and greatly speeding up the extraction. Subsequently, the solvents that are easily liquefied when being pressurized such as butane, propane and the like are used, which have a boiling point at or below zero, may be used for sealed extraction at low temperature and pressure, and may gasify without heating to be separated from the extract; it has the features of low extraction temperature, a short time, a simple process and mild reaction conditions, with substantially no solvent retention and the easiness to realize industrialization. Also, the extraction process is kept away from air, the extract is not easily oxidized, and the heat-sensitive components are not damaged. Finally, it is supplemented by a separation process and a molecular distillation process under certain conditions, thus obtaining cinnamon oil with a high yield. The experimental results show that the yield of extracting crude essential oil by the method provided in the present invention can reach 7.5%, and the cinnamaldehyde content in the purified essential oil can reach 97%.

To further understand the present invention, the method for extracting cinnamon oil provided by the present invention is described below in conjunction with examples, and the protection scope of the present invention is not limited by the following examples.

EXAMPLE 1

Pulverization and Conditioning of the Cinnamon:

the cinnamon was pulverized, screened by a 40 mesh sieve, wet evenly with an aqueous NaCl solution (concentration 2%) having a mass of 5% of the raw material mass, stirred well, then sealed and rested for 2 h to complete the conditioning and obtain a conditioned cinnamon powder.

Freezing and Thawing of the Cinnamon Powder:

the conditioned cinnamon powder was put into a freezing device at a temperature of −10° C., frozen for 9 h, then taken out and thawed rapidly by microwave radiation in a microwave device for 10 min before obtaining the thawed cinnamon powder.

Extraction of the Cinnamon Powder at a Low Temperature:

the thawed cinnamon powder was loaded into a 150 mesh net, the opening was tied, and it was put into a sealable extraction tank with a lid that could withstand a pressure of 1.3 MPa; the extraction tank was vacuumized and then butane was injected thereto with an adding ratio of the solvent to the material of 7:1 (V/m); the temperature of the extraction tank was adjusted to 30° C., and the pressure of the extraction tank was controlled accordingly to keep the extracting solvent always in a liquid state for the extraction; after extracting for 30 min, the liquid extract was led from the extraction tank into a sealable separation tank with a lid that could withstand a pressure of 1.3 MPa and had been previously vacuumized, the temperature of the separation tank was kept at 25° C., the solvent gasified from the top of the separation tank was recovered using a diaphragm compressor until the pressure in the separation tank dropped to 0.1 Mpa or below, and the extracted crude essential oil of cinnamon oil was retained at the bottom of the separation tank after it was separated from the solvent; here the yield of the crude essential oil was 6%.

Classification and Purification of the Crude Essential Oil:

the extracted crude essential oil was led out from the bottom of the separation tank into a molecular distillation device and distilled under a vacuum degree of $10^{-5}$ Mpa at a temperature of 65° C. to obtain a heavy phase of non-volatile components and a light phase of essential oil of cinnamon oil. The yield of the light phase of essential oil was 1.8%, wherein the cinnamaldehyde content was 90%.

EXAMPLE 2

Pulverization and Conditioning of the Cinnamon:

the cinnamon was pulverized, screened by a 60 mesh sieve, wet evenly with an aqueous $NaHCO_3$ solution (concentration 10%) having a mass of 15% of the raw material mass, stirred well, then sealed and rested for 5 h to complete the conditioning and obtain a conditioned cinnamon powder.

Freezing and Thawing of the Cinnamon Powder:

the conditioned cinnamon powder was put into a freezing device at a temperature of −15° C., frozen for 8 h, then taken out and thawed rapidly by microwave radiation in a microwave device for 5 min before obtaining the thawed cinnamon powder.

Extraction of the Cinnamon Powder at a Low Temperature:

the thawed cinnamon powder was loaded into a 200 mesh net, the opening was tied, and it was put into a sealable extraction tank with a lid that could withstand a pressure of 1.3 MPa; the extraction tank was vacuumized and then butane was injected thereto with an adding ratio of the solvent to the material of 10:1 (V/m); the temperature of the extraction tank was adjusted to 20° C., and the pressure of the extraction tank was controlled accordingly to keep the extracting solvent always in a liquid state for the extraction; after extracting for 20 min, the liquid extract was led from the extraction tank into a sealable separation tank with a lid that could withstand a pressure of 1.3 MPa and had been previously vacuumized, the temperature of the separation tank was kept at 15° C., the solvent gasified from the top of the separation tank was recovered using a diaphragm compressor until the pressure in the separation tank dropped to 0.05 Mpa or below, and the extracted crude essential oil was retained at the bottom of the separation tank after it was separated from the solvent; here the yield of the crude essential oil was 4.5%.

Classification and Purification of the Crude Essential Oil:

the extracted crude essential oil was led out from the bottom of the separation tank into a molecular distillation device and distilled under a vacuum degree of $10^{-5}$ Mpa at a temperature of 50° C. to obtain a heavy phase of non-volatile components and a light phase of essential oil of cinnamon oil. The yield of the purified essential oil was 1.8%, wherein the cinnamaldehyde content was 92%.

EXAMPLE 3

Pulverization and Conditioning of the Cinnamon:

the cinnamon was pulverized, screened by a 80 mesh sieve, wet evenly with an aqueous solution (concentration 12%) of NaCl and $NaHCO_3$ (mixing mass ratio 1:2) having a mass of 15% of the raw material mass, stirred well, then sealed and rested for 8 h to complete the conditioning and obtain a conditioned cinnamon powder.

Freezing and Thawing of the Cinnamon Powder:

the conditioned cinnamon powder was put into a freezing device at a temperature of −20° C., frozen for 5 h, then taken out and thawed rapidly by microwave radiation in a microwave device for 20 min before obtaining the thawed cinnamon powder.

Extraction of the Cinnamon Powder at a Low Temperature:

the thawed cinnamon powder was loaded into a 300 mesh net, the opening was tied, and it was put into a sealable extraction tank with a lid that could withstand a pressure of 1.3 MPa; the extraction tank was vacuumized and then propane was injected thereto with an adding ratio of the solvent to the material of 5:1 (V/m); the temperature of the extraction tank was adjusted to 10° C., and the pressure of the extraction tank was controlled accordingly to keep the extracting solvent always in a liquid state for the extraction; after extracting for 50 min, the liquid extract was led from the extraction tank into a sealable separation tank with a lid that could withstand a pressure of 1.3 MPa and had been previously vacuumized, the temperature of the separation tank was kept at 5° C., the solvent gasified from the top of the separation tank was recovered using a diaphragm compressor until the pressure in the separation tank dropped to 0.06 Mpa or below, and the extracted crude essential oil was retained at the bottom of the separation tank after it was separated from the solvent; here the yield of the crude essential oil was 7.5%.

Classification and Purification of the Crude Essential Oil:

the extracted crude essential oil was led out from the bottom of the separation tank into a molecular distillation device and distilled under a vacuum degree of $2\times10^{-5}$ Mpa at a temperature of 57° C. to obtain a heavy phase of non-volatile components and a light phase of essential oil. The yield of the purified essential oil was 2.2%, wherein the cinnamaldehyde content was 95%.

EXAMPLE 4

Pulverization and Conditioning of the Cinnamon:

the cinnamon was pulverized, screened by a 80 mesh sieve, wet evenly with an aqueous solution (concentration 1%) of NaCl and $NaHCO_3$ (mixing mass ratio 1:5) having a mass of 15% of the raw material mass, stirred well, then sealed and rested for 3 h to complete the conditioning and obtain a conditioned cinnamon powder.

Freezing and Thawing of the Cinnamon Powder:

the conditioned cinnamon powder was put into a freezing device at a temperature of −15° C., frozen for 3 h, then taken out and thawed rapidly by microwave radiation in a microwave device for 15 min before obtaining the thawed cinnamon powder.

Extraction of the Cinnamon Powder at a Low Temperature:

the thawed cinnamon powder was loaded into a 300 mesh net, the opening was tied, and it was put into a sealable extraction tank with a lid that could withstand a pressure of 1.3 MPa; the extraction tank was vacuumized and then a mixed solvent of propane and butane (mixing volume ratio 1:2) was injected thereto with an adding ratio of the solvent to the material of 6:1 (V/m); the temperature of the extraction tank was adjusted to 15° C., and the pressure of the extraction tank was controlled accordingly to keep the extracting solvent always in a liquid state for the extraction; after extracting for 40 min, the liquid extract was led from the extraction tank into a sealable separation tank with a lid that could withstand a pressure of 1.3 MPa and had been previously vacuumized, the temperature of the separation tank was kept at 10° C., the solvent gasified from the top of the separation tank was recovered using a diaphragm compressor until the pressure in the separation tank dropped to 0.08 Mpa or below, and the extracted crude essential oil was retained at the bottom of the separation tank after it was separated from the solvent; here the yield of the crude essential oil was 7.0%.

Classification and Purification of the Crude Essential Oil:

the extracted crude essential oil was led out from the bottom of the separation tank into a molecular distillation device and distilled under a vacuum degree of $5\times10^{-5}$ Mpa at a temperature of 65° C. to obtain a heavy phase of non-volatile components and a light phase of essential oil. The yield of the purified essential oil was 2.1%, wherein the cinnamaldehyde content was 97%.

EXAMPLE 5

Pulverization and Conditioning of the Cinnamon:

the cinnamon was pulverized, screened by a 60 mesh sieve, wet evenly with an aqueous $NaHCO_3$ solution (concentration 5%) having a mass of 8% of the raw material mass, stirred well, then sealed and rested for 5 h to complete the conditioning and obtain a conditioned cinnamon powder.

Freezing and Thawing of the Cinnamon Powder:

the conditioned cinnamon powder was put into a freezing device at a temperature of −10° C., frozen for 6 h, then taken out and thawed rapidly by microwave radiation in a microwave device for 10 min before obtaining the thawed cinnamon powder.

Extraction of the Cinnamon Powder at a Low Temperature:

the thawed cinnamon powder was loaded into a 200 mesh net, the opening was tied, and it was put into a sealable extraction tank with a lid that could withstand a pressure of 1.3 MPa; the extraction tank was vacuumized and then propane was injected thereto with an adding ratio of the solvent to the material of 10:1 (V/m); the temperature of the extraction tank was adjusted to 10° C., and the pressure of the extraction tank was controlled accordingly to keep the extracting solvent always in a liquid state for the extraction; after extracting for 30 min, the liquid extract was led from the extraction tank into a sealable separation tank with a lid that could withstand a pressure of 1.3 MPa and had been previously vacuumized, the temperature of the separation tank was kept at 8° C., the solvent gasified from the top of the separation tank was recovered using a diaphragm compressor until the pressure in the separation tank dropped to 0.05 Mpa or below, and the extracted crude essential oil was retained at the bottom of the separation tank after it was separated from the solvent; here the yield of the crude essential oil was 7.2%.

Classification and Purification of the Crude Essential Oil:

the extracted crude essential oil was led out from the bottom of the separation tank into a molecular distillation device and distilled under a vacuum degree of $1\times10^{-5}$ Mpa at a temperature of 47° C. to obtain a heavy phase of non-volatile components and a light phase of essential oil. The yield of the purified essential oil was 2.1%, wherein the cinnamaldehyde content was 91%.

The method for extracting cinnamon oil provided in the present invention is presented in detail above. Specific individual examples are used herein to explain the principle and embodiments of the present invention, and the illustration of the above examples is only to help understanding the method and the core concept of the present invention. It should be noted that for those of ordinary skill in the art, several improvements and modifications may be made to the present invention without departing from the inventive principle, and these improvements and modifications also fall within the protection scope of the claims of the present invention.

What is claimed:

1. A method for extracting cinnamon oil, comprising the steps of:

A) mixing and conditioning a cinnamon powder with an aqueous solution of sodium salts, and obtaining the conditioned cinnamon powder thereafter;

B) freezing and then rapidly thawing the conditioned cinnamon powder obtained in the above step, and obtaining the thawed cinnamon powder thereafter; and C) after mixing the thawed cinnamon powder with a gaseous solvent, carrying out pressurized liquid extraction, and then after separation obtaining the cinnamon oil.

2. The method according to claim 1, wherein the cinnamon powder has a particles diameters of 40~80 mesh.

3. The method according to claim 1, wherein the aqueous solution of sodium salts includes aqueous solutions of sodium chloride and/or sodium bicarbonate;

the aqueous solution of sodium salts has a mass concentration of 1%-12%, and the mass ratio of the aqueous solution of sodium salts to the cinnamon powder is 5%~15%.

4. The method according to claim 1, wherein the conditioning is sealing and resting; the conditioning time is 2~8 h.

5. The method according to claim 1, wherein the freezing temperature is 10° C.~−20° C., and the freezing time is 3~9 h.

6. The method according to claim 1, wherein the temperature rising rate of the rapid-thawing is 1~10° C./min, and the rapid thawing time is 5~20 min.

7. The method according to claim 1, wherein the gaseous solvent has a boiling point temperature of −50° C.~1° C., and the ratio of the gaseous solvent volume to the cinnamon powder mass is (5~10)ml:1 g;

the gaseous solvent includes propane and/or butane.

8. The method according to claim 1, wherein the extraction temperature is 10~45° C., the extraction pressure is 0.1~1 MPa, and the extraction time is 10~50 min.

9. The method according to claim 1, wherein a purification step is also included after the separation.

10. The method according to claim 9, wherein the purification is purification by molecular distillation;

the molecular distillation pressure is $10^{-4}$~$10^{-5}$ MPa, and the molecular distillation temperature is 45~65° C.

* * * * *